US007993106B2

(12) United States Patent
Walters

(10) Patent No.: US 7,993,106 B2
(45) Date of Patent: Aug. 9, 2011

(54) CORE FOR USE IN A CASTING MOULD

(75) Inventor: Sean A. Walters, Bristol (GB)

(73) Assignee: Rolls-Royce PLC, London (GB)

( * ) Notice: Subject to any disclaimer, the term of this patent is extended or adjusted under 35 U.S.C. 154(b) by 925 days.

(21) Appl. No.: 11/984,973

(22) Filed: Nov. 26, 2007

(65) Prior Publication Data

US 2008/0138208 A1 Jun. 12, 2008

(30) Foreign Application Priority Data

Dec. 9, 2006 (GB) ..... 0624593.0

(51) Int. Cl.
*B22C 9/10* (2006.01)

(52) U.S. Cl. ..... 416/232

(58) Field of Classification Search ..... 29/889.721; 416/232

See application file for complete search history.

(56) References Cited

U.S. PATENT DOCUMENTS

| | | | | |
|---|---|---|---|---|
| 2,972,805 | A * | 2/1961 | Turner et al. | 29/889.721 |
| 5,947,181 | A | 9/1999 | Davis | |
| 6,979,173 | B2 * | 12/2005 | Tiemann | 416/232 |
| 2003/0138322 | A1 * | 7/2003 | Boury et al. | 416/97 R |
| 2006/0249275 | A1 | 11/2006 | Judet | |
| 2007/0020100 | A1 * | 1/2007 | Beeck et al. | 416/193 A |
| 2007/0181283 | A1 | 8/2007 | Judet | |

FOREIGN PATENT DOCUMENTS

| | | | |
|---|---|---|---|
| EP | 0 818 256 | A1 | 1/1998 |
| EP | 1 634 665 | A2 | 3/2006 |
| EP | 1 637 253 | A1 | 3/2006 |
| EP | 1 772 210 | A2 | 4/2007 |
| GB | 2 096 523 | A | 10/1982 |
| WO | WO 94/12767 | | 6/1994 |

OTHER PUBLICATIONS

Search Report mailed Mar. 5, 2008, completed Feb. 26, 2008 in European Application No. Ep 07 07 9509.

* cited by examiner

*Primary Examiner* — Richard Edgar

(74) *Attorney, Agent, or Firm* — Oliff & Berridge, PLC

(57) ABSTRACT

A core, for use in a casting mould to form a cavity in a cast component such as a blade or vane of a gas turbine engine. The core has a relatively fragile thin-walled region. A bead is formed along a lateral edge of the thin-walled portion in order to reduce cracking or other damage in the thin-walled portion.

11 Claims, 2 Drawing Sheets

CORE FOR USE IN A CASTING MOULD

BACKGROUND

This invention relates to a core for use in a casting mould, and is particularly, although not exclusively, concerned with a ceramic core for use in a mould for casting aerofoil components such as turbine blades and stator vanes of a gas turbine engine.

Stator vanes and blades in turbine stages of a gas turbine engine are commonly provided with internal cavities and passages to allow the flow of cooling air within the component. The blades and vanes may be made by casting, and the cavities and passages may be formed at least partially by positioning a ceramic core within the casting mould. More specifically, such components may be made by a form of investment casting known as the "lost-wax" process. In the lost-wax process, a wax pattern of the component to be cast is formed by injection moulding, around the ceramic core. The wax pattern, including the core, is then dipped into a ceramic slurry, which is then dried. The dipping process is repeated until an adequate thickness of ceramic has been built up, after which the ceramic mould is heated to melt the wax, which is removed from the mould interior. Molten alloy is poured into the mould. When the alloy has solidified, the mould is broken and the ceramic core is removed by leaching to leave the finished cast component.

SUMMARY

Some aerofoil components include a cavity having a narrow region which is formed by a core having a correspondingly thin-walled portion. The thin-walled portion may be perforated, so that, in the casting process, pedestals are formed within the narrow cavity region to support the walls of the component.

The thin-walled portion of the core is very fragile, and consequently the core is prone to breakage in the manufacturing process, either through mishandling or through stresses induced during the moulding of the wax pattern, owing to wax pressures or stresses imparted by the die, or during the casting process itself, owing to molten metal momentum (where it is a metallic material being cast) or to induced strains during casting material cooling.

According to the present invention there is provided a core for use in a casting mould, to form a cavity in a component cast in the mould, the core including a thin-walled portion extending from a thicker portion of the core towards a terminal edge of the core, characterised in that a lateral edge of the thin-walled portion terminates at a bead which is thicker than the thin-walled portion, the bead defining a lateral edge of the core.

The bead serves to reinforce the lateral edge of the thin-walled portion, thus resisting damage to the lateral edge and cracking within the thin-walled portion.

The bead may be one of two beads disposed at opposite lateral edges of the thin-walled portion, both beads defining lateral edges of the core. The lateral edges may be substantially parallel to each other. Alternatively the lateral edges may be at an angle to one another.

The terminal edge of the core may be defined by a rib which is thicker than the thin-walled portion, and which, when two beads are provided at opposite lateral edges, may extend between respective ends of the beads.

The thin-walled portion may be perforated, in which case the perforations may comprise holes which lie on at least one line-extending transversely of the or each lateral edge.

The component to be cast in the mould may include an aerofoil portion including a cavity portion formed by the thin-walled portion.

Another aspect of the present invention provides a cast component having a cavity formed by a core as defined above.

The component may have an external surface which extends generally parallel to an internal surface of a cavity region formed by the thin-walled portion, and to a surface portion of the bead adjacent to the thin-walled portion.

The component may have an aerofoil portion and a shroud portion, the cavity region formed by the bead being situated at the transition from the aerofoil portion to the shroud portion.

The component may be a blade or vane for a gas turbine engine.

BRIEF DESCRIPTION OF THE DRAWINGS

For a better understanding of the present invention, and to show more clearly how it may be carried into effect, reference will now be made, by way of example, to the accompanying drawings, in which: —

DETAILED DESCRIPTION OF EMBODIMENTS

Figure 1:
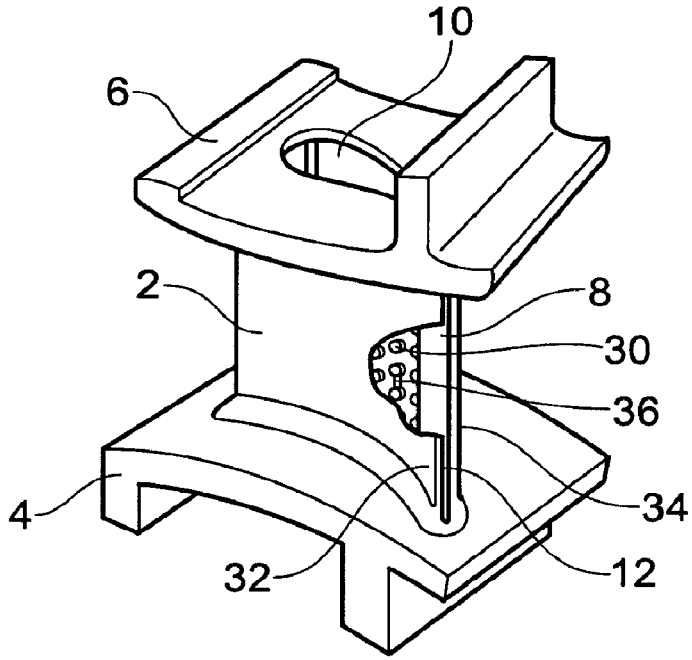
FIG. 1 RELATED ART
FIG. 1 shows a turbine stator vane.

The vane shown in FIG. 1 comprises an aerofoil portion 2 and inner and outer shroud portions 4, 6. The vane has an internal cavity 8 which opens to the exterior at a passage 10 in the shroud portion 6 and a corresponding passage (not visible) in the shroud portion 4. The cavity 8 also communicates with the exterior through a slot 12 at the trailing edge of the vane. The vane is made from a high temperature aerospace alloy by a lost-wax casting process.

Figure 2:
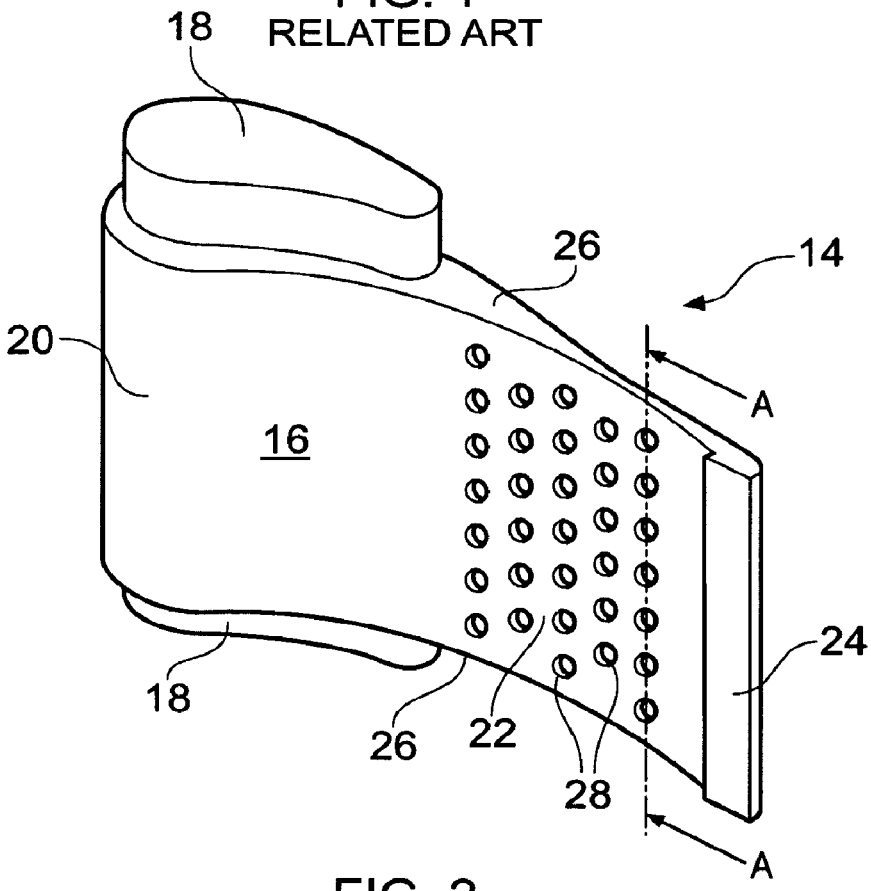
FIG. 2 RELATED ART
FIG. 2 shows a ceramic core in accordance with the prior art, for use in the manufacture of the vane of FIG. 1.

The cavity 8 and the passages 10 are formed in the vane during the casting process by a core 14 shown in FIG. 2. The core has a main body 16 which forms the cavity 8, and extensions 18 which form the passages 10. The body 16 is of generally aerofoil shape, and has a thicker portion 20, which tapers down to a thin-walled portion 22, that is to say a portion having a thin cross-section. The thin-walled portion 22 terminates, at a location corresponding to the trailing edge of the vane of FIG. 1, in a rib 24 which is thicker than the thin-walled portion. The rib 24 serves to form the end of the slot 12 in the cast vane.

The body 20 has lateral edges 26, which also constitute the lateral edges of the thin-walled portion 22. The thin-walled portion 22 is perforated by holes 28. In the cast vane as shown in FIG. 1, the holes 28 form pedestals 30 which extend between walls 32, 34 of the aerofoil portion 2 defining the cavity 8. The holes 28, in the embodiment shown in FIG. 2, are disposed in an array constituted by rows of holes lying on lines extending perpendicularly between the lateral edges 26. As illustrated, one such line is represented by the section line A-A.

Figure 3:
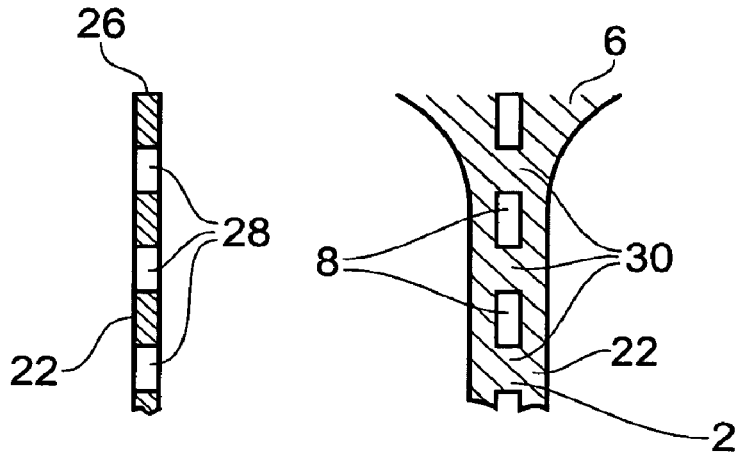
FIG. 3 RELATED ART
FIG. 3 is a partial sectional view of the core of FIG. 2 taken on the line A-A in FIG. 2, and of the vane cast using the core.

FIG. 3 shows, on the left side, a partial section view of the thin-walled portion 22 taken on the section line A-A.

It will be appreciated that the thin-walled portion 22 is fragile, by comparison with the thicker portion 20 of the body 16 and the rib 24. Furthermore, the perforation by the holes 28 contributes to the weakness of the thin-walled portion 22. In practice, damage to the core 14 is often initiated by failure at one of the edges 26 of the thin-walled portion 22, and the crack may propagate into the thin-walled portion 22, frequently between individual holes 28, for example along a line of holes extending between the lateral edges 26.

Cracking of this kind creates a potential path for metal ingress (where a metallic material is being cast) and hence result in casting flash in the cast component. For example, as represented in FIG. 1, casting flash 36 may form between individual pedestals 30 in the cast vane, these gaps corresponding to cracked regions between adjacent holes 28 in the core 14.

This flash 36 restricts air flow within the cavity 8, and can lead to cooling air starvation at the trailing edge of the vane, resulting in local overheating. If detected during inspection of the casting, it may be possible to carry out salvage work to remove accessible flash, but frequently this cannot be performed economically and the component must be rejected. If not detected and remedied there may be premature deterioration of the trailing edge of the aerofoil portion 2 in service.

Figure 4:
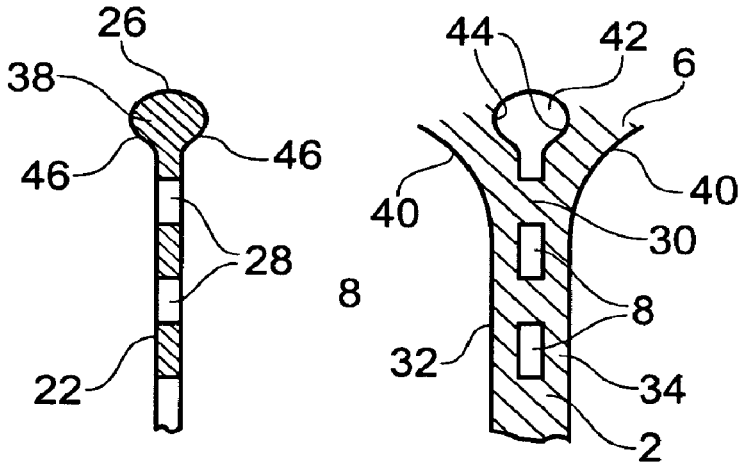
FIG. 4 corresponds to FIG. 3 but shows a core and vane in accordance with the present invention.

FIG. 4 shows a modification of the core 14 to avoid damage to the core. A bead 38 is provided along the lateral edge 26 of at least the thinnest part of the thin-walled portion 22. Being thicker than the thin-walled portion 22, the bead 38 resists damage, and in particular the initiation of cracks at the lateral edge 26, and so substantially reduces damage within the thin-walled portion 22. This minimises the occurrence of regions of flash 36 in the cast component. Consequently, the economic consequences of component rejection and salvage work can be avoided.

The right side of FIG. 4 shows the region of the vane of FIG. 1 corresponding to the core shown on the left side of FIG. 4. The aerofoil portion 2 merges into the outer shroud portion 6 at a curved transition surface 40 on each side. A bead cavity region 42, corresponding to the bead 38, is formed at this transition between the aerofoil portion 2 and the shroud portion 6, this bead cavity region 42 having a bulbous or "mushroom" shape including diverging surface regions 44. The corresponding surface regions 46 on the bead 38 are shaped so that the surface regions 44 of the bead cavity region 42 generally follow the curvature of the transition surfaces 40 and preferably are approximately parallel to them. The result is that the rate of change of the wall thickness of the vane at the lateral edges of the cavity is minimised. Preferably, the wall thickness remains generally constant over the inner and outer (or "pressure and suction") walls 32 and 34, past the bead cavity region 42 and into the shroud portion 6. This has advantages in that residual stresses are reduced in the finished component, and stress concentrations during engine operation can be avoided.

Figure 5:
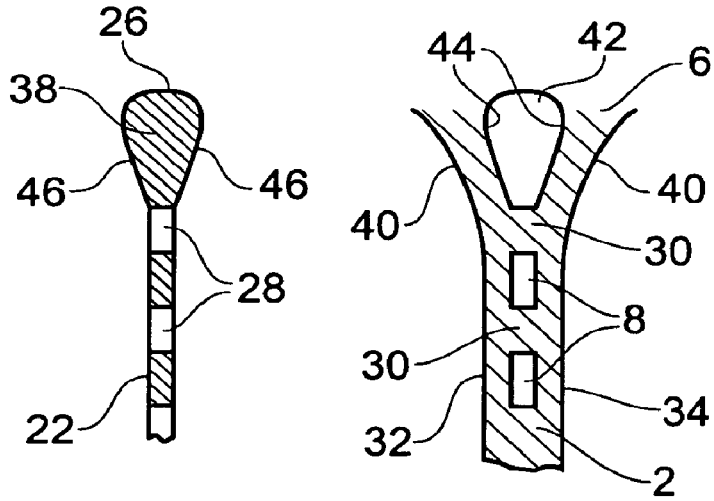
FIG. 5 corresponds to FIG. 4, but shows an alternative form of core and vane.

An alternative configuration for the bead 38 and the resulting bead cavity region 42 is shown in FIG. 5. In this embodiment, the bead shape is modified so that the surface regions 44 follow an alternative profile for the transition surface 40, being more in the form of a truncated teardrop.

Because the bead is situated within the transition between the aerofoil portion 2 and the inner and outer shroud portions 4, 6, it does not affect the trailing edge of the aerofoil portion 2, so that the airflow regime over the vane is not disrupted. Also, the bead 38 is small by comparison with the total flow cross-section over the slot formed by the thin-walled portion 22 of the core 14. Consequently, the cooling airflow distribution through the slot is substantially unaffected by the bead cavity region 42.

The invention claimed is:

1. A core configured to form a cavity in a component cast of a mould, the core comprising:

a thicker portion;

a terminal edge;

a thin-walled portion extending from the thicker portion towards the terminal edge; and a bead defining a lateral edge of the thin-walled portion and extending substantially between the thicker portion and the terminal edge of the core, wherein the bead is thicker than the thin-walled portion of the core.

2. The core as claimed in claim 1, wherein the bead is one of a pair of beads defining opposite lateral edges of the core the thin-walled portion.

3. The core as claimed in claim 2, wherein the lateral edges are substantially parallel to each other.

4. The core as claimed in claim 1, wherein the terminal edge of the core is defined by a rib which is thicker than the thin-walled portion.

5. The core as claimed in claim 1, wherein the thin-walled portion is perforated.

6. The core as claimed in claim 5, wherein the thin-walled portion is perforated by holes which lie on at least one line extending transversely between each lateral edge.

7. The core as claimed in claim 1, wherein the core is shaped to form a cavity in an aerofoil portion of the cast component.

8. A cast component having a cavity formed by the core as claimed in claim 1.

9. The cast component as claimed in claim 8, wherein an external surface of the component lies substantially parallel to a surface region of a bead cavity region formed by the bead.

10. The cast component as claimed in claim 9, wherein the cast component has an aerofoil portion and a shroud portion, the bead cavity region formed by the bead being situated at the transition from the aerofoil portion to the shroud portion.

11. The cast component as claimed in claim 8, which is a blade or a vane for a gas turbine engine.

* * * * *